United States Patent [19]

Boden

[11] Patent Number: 4,460,499

[45] Date of Patent: Jul. 17, 1984

[54] METHOD FOR ENCAPSULATING RADIOACTIVE WASTE CONCENTRATES INTO NON-DEFORMABLE ASPHALT IN A MANNER READY FOR ULTIMATE DISPOSAL

[75] Inventor: Hellmut Boden, Stuttgart, Fed. Rep. of Germany

[73] Assignee: Werner & Pfleiderer, Stuttgart, Fed. Rep. of Germany

[21] Appl. No.: 328,820

[22] Filed: Dec. 9, 1981

[30] Foreign Application Priority Data

Dec. 22, 1980 [DE] Fed. Rep. of Germany ..... 3048543

[51] Int. Cl.[3] ..... G21F 9/16

[52] U.S. Cl. ..... 252/628; 252/633; 264/DIG. 32

[58] Field of Search ..... 252/628, 633, 626; 264/DIG. 32

[56] References Cited

U.S. PATENT DOCUMENTS

| | | | |
|---|---|---|---|
| 1,304,483 | 5/1919 | Inoue | 264/DIG. 32 |
| 3,971,732 | 7/1976 | Meier | 252/628 |

FOREIGN PATENT DOCUMENTS

| | | | |
|---|---|---|---|
| 2548251 | 4/1977 | Fed. Rep. of Germany | 252/628 |
| 59300 | 5/1977 | Japan | 252/628 |
| 146100 | 12/1978 | Japan | 252/628 |
| 112500 | 9/1979 | Japan | 252/628 |
| 14196 | 2/1981 | Japan | 252/628 |
| 502558 | 4/1979 | U.S.S.R. | 252/628 |

*Primary Examiner*—Deborah L. Kyle
*Assistant Examiner*—Howard J. Locker
*Attorney, Agent, or Firm*—Roberts, Spiecens & Cohen

[57] ABSTRACT

Radioactive waste concentrates encapsulated into non-deformable asphalt at the inlet of an extruder feeding hard asphalt granules and hydrocarbon oil for mixing therein and downstream of the initial mixing adding the radioactive waste concentrates for mixing with the initial mixture.

14 Claims, 1 Drawing Figure

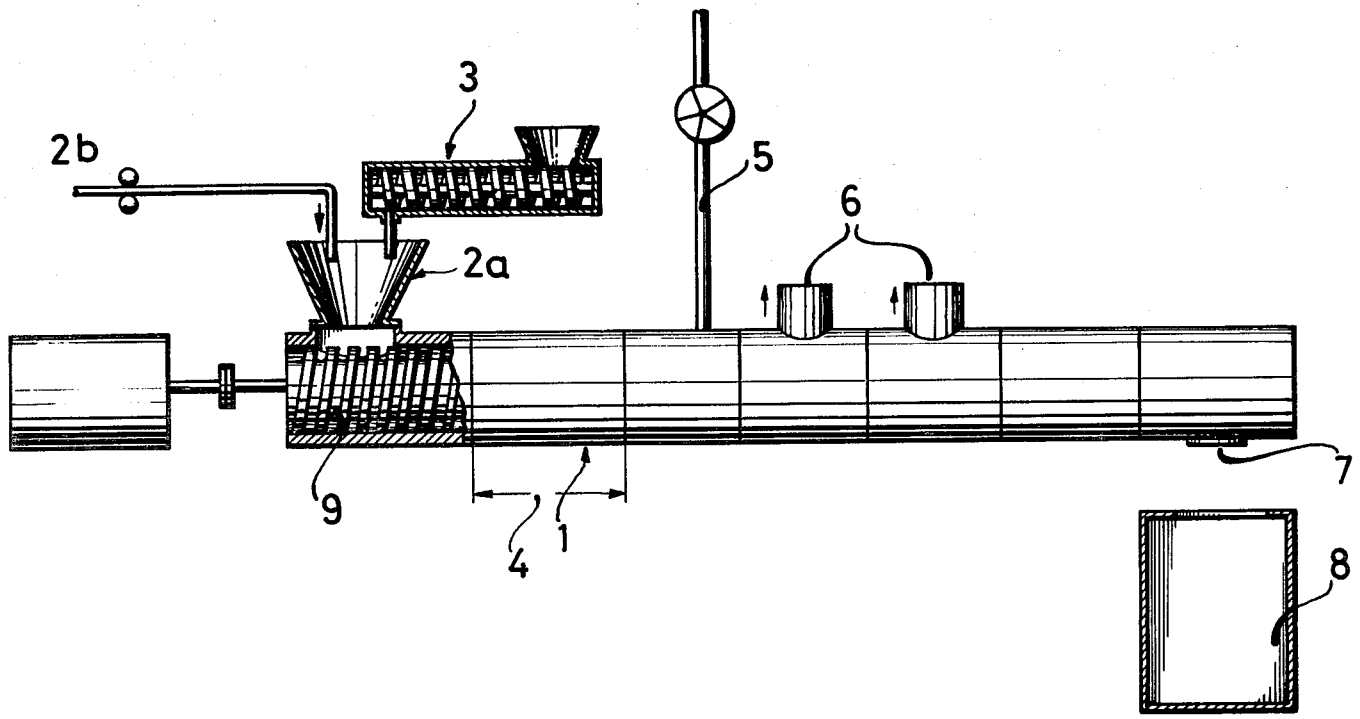
7
8
6
5
1
4
3
2a
9
2b

METHOD FOR ENCAPSULATING RADIOACTIVE WASTE CONCENTRATES INTO NON-DEFORMABLE ASPHALT IN A MANNER READY FOR ULTIMATE DISPOSAL

BACKGROUND OF THE INVENTION

The present invention relates to a method for encapsulating radioactive waste concentrates into non-deformable asphalt in a manner ready for ultimate disposal.

Radioactive waste waters which are produced in large quantities in industrial nuclear plants are customarily decontaminated by evaporation. In this way the waste water is concentrated to an aqueous sludge having a salt content of up to about 40%. Low-salt waters from circuits of the reactors are, on the other hand, purified by ion exchangers whose filter resins must be regularly flushed out whereby small amounts of radioactive waste waters are obtained.

The aqueous sludges or concentrates are thereupon freed of the greater part of the residual water in apparatus suitable for this purpose and encapsulated in a solidification substance for their ultimate disposal.

In this connection it has been found particularly advantageous to use hot asphalt as the solidification substance since concentrates and resins having about 60 wt% salt can be encapsulated therein.

From West German Pat. No. 2,240,119 a method is known, for instance, for encapsulating radioactively contaminated filter substances in asphalt in which the filter materials, after prior partial removal of water are introduced together with radioactive aqueous precipitation sludge and hot-liquid asphalt into a worm machine for the encapsulating. In this case the radioactive particles are admixed into the asphalt while at the same time the residual water present is expelled to the greater part by evaporation with the addition of heat. The asphalts used in this method solidify at room temperature but, as a result of their amorphous structure, when they are solidified they possess the necessary elasticity to permit limited deformations upon the action of sudden stresses. In view of this amorphous structure, they can be dosed only in the liquid state so that heat-controlled liquid storage is necessary.

Thus, tanks are required for storage, these tanks resulting in high investment costs in addition to requiring a large amount of space and energy.

The comminuting and storing of these grades of asphalt in granular form encounters considerable difficulty since agglomeration occurs upon storage so that exact dosaging is made difficult.

It has already been attemped to reduce the sticking and lumping of the asphalt by adding separating agents so as thereby to permit storage in solid form, but this has not led to the desired results.

Powdered grades of hard asphalt that can be used, for instance, as foundry sand are, to be sure, also known and customary on the market. As in the case of softer grades of asphalt (for instance B 15 of Shell or Ebano 25 of Esso), they are produced in a distillation process, additional hydrocarbon oils being additionally extracted in another evacuation process. Hard asphalt is not suitable for the encapsulating of radioactive waste concentrates or sludges and thus cannot be disposed of with sufficient assurance of safety.

SUMMARY OF THE INVENTION

It has now been found that hard asphalt that is suitable for the storage and dosaging can also be used to advantage for the encapsulating of radioactive waste substances in the manner that the conversion of the asphalt into a different grade takes place directly upon the mixing of such waste substances.

It has been found in this connection that this conversion practically directly in combination with the known method of encapsulating radioactive waste substances in the extruder is made possible if the hydrocarbon oil removed from the hard asphalt in the extraction process upon its production is returned to the hard asphalt in the quantity corresponding to that in which it was removed, with intensive mixing and supply of heat in the extruder directly before the admixing of the radioactive particles.

An object of the present invention is to provide a method for encapsulating radioactive waste concentrates which, despite the structurally caused tackiness of the asphalt, makes it possible to dose it at room temperature in solid form during the encapsulation process.

This object is achieved in accordance with the invention by a method of the type set forth in the preamble of claim 1 which has the characteristic features set forth in the body of claim 1.

Hard asphalt, which can be brought into a powdered or granular form as a result of its low penetration, can be stored in barrels at room temperature. It does not tend to form lumps and can accordingly be easily dosed, for instance by means of a feed worm.

The required conversion into an asphalt of higher penetration can be effected without additional expense during the part of the process in which the incorporating and mixing of the radioactive waste concentrates is continuously carried out. The conversion takes place preferably at temperatures of up to 200° C., whereby optimal mixing with the hydrocarbon oil added for this purpose is obtained.

By the addition of the hard asphalt in a particle size of up to 5 mm, as effected in accordance with another feature of the invention, there is obtained an optimal precision of dosage which makes possible an exact determination of the quality of the solidification substance in combination with the amount of hydrocarbon oil added.

DESCRIPTION OF THE DRAWING

The invention will be explained in further detail below with reference to an example of the method shown diagrammatically in the sole FIGURE of the drawing.

DETAILED DESCRIPTION OF THE PREFERRED EMBODIMENT OF THE INVENTION

Hard asphalt, for instance of type S 110/120 is fed in ground condition by means of a dosaging worm 3 at the inlet end into the hopper 2*a* of a double-shaft worm machine 1 having worm elements 9 which engage in and strip each other. Preferably the hard asphalt has a grain size of up to 5 mm. At the same time hydrocarbon oil is added via the inlet 2*b* as asphalt extract, so-called flux oil, for instance of type S-5273 (Wintershall) of a density of 15° C. of about 1 gr/ml and of a viscosity at 100° C. of 29 $mm^2$/sec. In this connection, preferably about 76 parts by wt% of hard asphalt with 24 parts of hydrocarbon oil are melted in the worm machine 1 at a treatment temperature of up to about 200° C. and mixed together. There is thereby produced a grade of asphalt which corresponds approximately to the above-mentioned B 15 (Shell).

Downstream of the mixing path 4, which has a length of L=3 D (diameter of the worm), the radioactive waste concentrate or radioactive precipitation sludges are added in dosed quantity by means of the dosaging device 5.

In the region of the place of addition of the radionuclides the hard asphalt is homogenized to such an extent to form an asphalt of soft and elastic structure that the radio-nuclides can be admixed into a solidification substance which is suitable for ultimate disposal. Thereupon the water in the mixed material is removed to the greater part by the evaporation domes 6 and the final product is discharged through a discharge opening 7 into the ultimate disposal container 8 which receives it.

Due to the intensive mixing and shearing action of the worm and kneading elements 9 arranged on a shaft, it is possible to effect both a conversion of the hard asphalt as well as directly the homogeneous mixing of the radioactive waste substances with the prepared solidification substance within one and the same apparatus.

Another advantage of the method is obtained if, with a leaner adjustment of the quantitative flows of flux oil with respect to hard asphalt also somewhat harder grades of asphalt than, for instance, the aforementioned commercial B 15 are produced. These harder grades of asphalt are particularly preferred as solidification substance when the radioactive waste substances to be worked have a high level of activity or give rise to the expectation of a high integral dose rate during the ultimate disposal period.

I claim:

1. A method for the encapsulating of radioactive waste concentrates into non-deformable asphalt in a manner ready for ultimate disposal by the continous treatment of waste from industrial nuclear plants within an extruder with continuous evaporation of the water and admixing of the concentrate into the asphalt as a solidification substance for direct depositing within a container, characterized in that as solidification substance granulated asphalt and a hydrocarbon oil are introduced at the inlet end of the extruder in dosaged amount as components and are formed along a mixing path with addition of heat into a ductile asphalt into which the precipitation sludge is added downstream and homogeneously admixed with evaporation of the water contained therein.

2. A method according to claim 1, characterized by the fact that the preparation of the components of the solidification substance is effected at temperatures of up to 200° C.

3. A method according to claim 1 or 2, characterized by the fact that the granulated asphalt is added in the form of a pourable solid having a particle size of up to 5 mm.

4. A method according to claim 1 or 2, characterized by the fact that the components are added in a ratio of at least three parts of granulated asphalt to one part of hydrocarbon oil.

5. A method according to claim 1 wherein the conversion of the granulated asphalt to the ductile asphalt and the subsequent mixture thereof with the radioactive concentrate is effected within the same extruder and from which the final product is ready for direct deposit into a container.

6. A method according to claim 5 wherein the non-deformable asphalt in granulated form in introduced with the hydrocarbon oil into the extruder from separate sources of supply.

7. A method according to claim 6 wherein said non-deformable asphalt and hydrocarbon oil are mixed in the extruder along a length thereof to reform the granulated asphalt into said ductile asphalt which is relatively softer than the original granulated asphalt and is provided with a deformable structure before the radioactive concentrate is added to the mixture in said extruder.

8. A method for encapsulating radioactive waste concentrates in water into non-deformable asphalt for ultimate disposal comprising mixing by means of an extruder asphalt granules and hydrocarbon oil to reform the asphalt into a relatively softer, elastic structure, downstream of said mixing in the extruder adding the radioactive waste concentrates in controlled amounts for mixing with the asphalt-oil mixture in which the asphalt has been reformed, driving off the water in the asphalt-oil radioactive waste concentrates mixture by heating within the extruder, and delivering the final mixture from the extruder to a container whereby the mixing of the asphalt and oil and the subsequent mixing of the asphalt-oil mixture and the radioactive waste concentrates is effected within the same extruder.

9. The method of claim 8 wherein the mixing of the asphalt granules and hydrocarbon oil takes place at temperatures up to 200° C.

10. The method of claim 8 or 9 wherein the granule size is up to 5 mm.

11. The method of claim 8 or 9 wherein there are three parts of asphalt granules to one part of hydrocarbon oil.

12. A method according to claim 8 wherein the non-deformable asphalt in granulated form is introduced with the hydrocarbon oil into the extruder from separate sources of supply.

13. A method according to claim 12 wherein said asphalt granules are in a pourable state and are introduced through a hopper into the extruder.

14. A method according to claim 13 wherein the hydrocarbon oil is introduced into said hopper with the asphalt granules.

* * * * *